United States Patent [19]

McDonald

[11] 3,988,898

[45] Nov. 2, 1976

[54] PIPELINES AND MARINE PLATFORMS

[75] Inventor: Ronald D. McDonald, N. Vancouver, Canada

[73] Assignees: Intercontinental Marine Development Ltd.; The Laird Group Limited, both of England

[22] Filed: Dec. 26, 1974

[21] Appl. No.: 536,657

[52] U.S. Cl. ..... 61/98; 61/69 R; 166/.5

[51] Int. Cl.[2] ..... B63B 21/00; E21B 17/00

[58] Field of Search ..... 61/46.5, 46, 69 R; 166/.5; 114/.5 D, .5 R

[56] References Cited

UNITED STATES PATENTS

| | | | |
|---|---|---|---|
| 2,986,889 | 6/1961 | Ludwig | 61/46.5 |
| 3,294,185 | 12/1966 | O'Neill et al. | 61/69 R |
| 3,482,410 | 12/1969 | Roesky et al. | 61/69 R |
| 3,525,388 | 8/1970 | McClintock | 61/46.5 X |
| 3,601,189 | 8/1971 | Weiss | 166/.5 |

*Primary Examiner*—Dennis L. Taylor

*Attorney, Agent, or Firm*—Leydig, Voit, Osann, Mayer & Holt, Ltd.

[57] ABSTRACT

A marine platform is described incorporating a submerged buoyancy chamber which is anchored to drilled piles in the sea bed by cables. Each anchorage point lies inside a working chamber mounted on the pile to enable workmen inside the chamber to release the coupling between the cable and the pile when the cable needs to be replaced. The buoyancy chamber and the working chamber both have airlocks to enable the transfer of workmen between each chamber and a submersible craft. The buoyancy chamber supports a deck which lies above sea level. The deck is in fluid communication with a wellhead on the sea bed by means of risers. Each riser incorporates two concentric tubes. The inner tube carries oil from the wellhead and the other tube contains a hydraulic fluid through which valves at the wellhead can be controlled from the deck such that the valves close if riser rupture releases hydraulic pressure.

3 Claims, 5 Drawing Figures

PIPELINES AND MARINE PLATFORMS

BACKGROUND OF THE INVENTION

1. Field of the Invention

The invention relates to marine platforms such as for use in connection with undersea oil wells for example, and to pipelines such as for marine use for example.

2. Summary of the Invention

The invention provides in a tension leg platform having a buoyancy chamber anchored to the sea bed by means of tensioned legs, an anchoring arrangement for each leg comprising a pile driven into the sea bed, a chamber mounted on the pile and defining an orifice through which a said leg can extend into the chamber, and clamping means secured to the chamber and housed within the chamber, the clamping means clamping the leg to the chamber.

The invention further provides a pipe line for conveying a fluid from a first position to a second position, comprising a first tube extending from the first to the second position, a second tube extending from the first to the second position, the second tube lying inside the first tube and being arranged to feed fluid from the first to the second position, a valve coupled to the second tube at the first position to control the flow of fluid along the second tube, the valve being biased into a closed condition, means connected to the first tube to pressurise the first tube, and valve actuator means at the first position coupled to control the valve and connected to the first tube, the actuator means being operative in response to the pressure in the first tube exceeding a predetermined value to open the valve means against its bias.

The invention further provides a tension leg marine platform structure, comprising an air filled buoyancy chamber having an airlock, the airlock enabling access between the buoyancy chamber and a submersible craft when docked at the airlock, a deck, a plurality of columns supporting the deck on the chamber to lie above the level of the sea and providing access from the deck to the chamber, a plurality of tension legs each secured at one end to the buoyancy chamber, and a plurality of anchoring arrangements respectively for anchoring the other ends of the tension legs to the sea bed to hold the buoyancy chamber in a submerged state.

The invention further provides a tension leg marine platform structure, comprising an air filled buoyancy chamber having an airlock, the airlock enabling access between the buoyancy chamber and a submersible craft when docked at the airlock, a deck, a plurality of columns supporting the deck on the chamber to lie above the level of the sea and providing access from the deck to the chamber, a plurality of tension legs each secured at one end to the buoyancy chamber, and a plurality of anchoring arrangements respectively for anchoring the other ends of the tension legs to the sea bed to hold the buoyancy chamber in a submerged state.

BRIEF DESCRIPTION OF THE DRAWINGS

A tension leg marine platform embodying the invention will now be described, by way of example, with reference to the accompanying drawings in which.

DESCRIPTION OF THE PREFERRED EMBODIMENT

Figure 1:
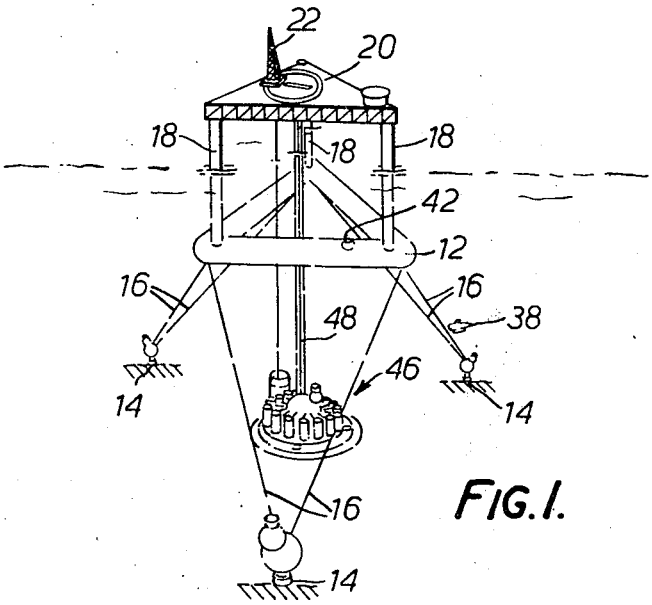
FIG. 1 is a perspective view of the tension leg marine platform secured to the sea bed.

As shown in FIG. 1, the tension leg marine platform includes a generally triangular buoyancy chamber 12 formed by welding together at their adjacent ends three steel tubes arranged in the form of a triangle. The buoyancy chamber 12 is anchored by means of a series of legs 16 to three piles 14 drilled into the sea bed. Each leg includes three or more separate cables.

Two legs extend from each pile 14 respectively to the opposite ends of a corresponding side of the triangular buoyancy chamber to form a triangle with that side. The legs are held in tension by the buoyancy of the chamber which is submerged below sea level at a depth of from 80 to 100 feet for example. At this depth, the tidal and wave motion have negligible effect on the chamber. The triangular arrangement of the legs ensures that the buoyancy chamber is rigidly held in a fixed position and is subject only to minimal movement.

Three upstanding columns 18, one at each corner of the triangular buoyancy chamber, rise above the surface of the sea and support a deck 20. The deck 20 in turn supports a drilling rig 22 and provides a landing area for helicopters and the like. The columns 18 have thin profiles so as to offer minimal resistance to wind and water, thus reducing unwanted movement of the structure.

A series of risers 48 extend from a wellhead cluster 46 on the sea bed up to the deck 20 to enable oil from the wellhead cluster 46 to be brought onto the deck 20 for processing.

Figure 2:
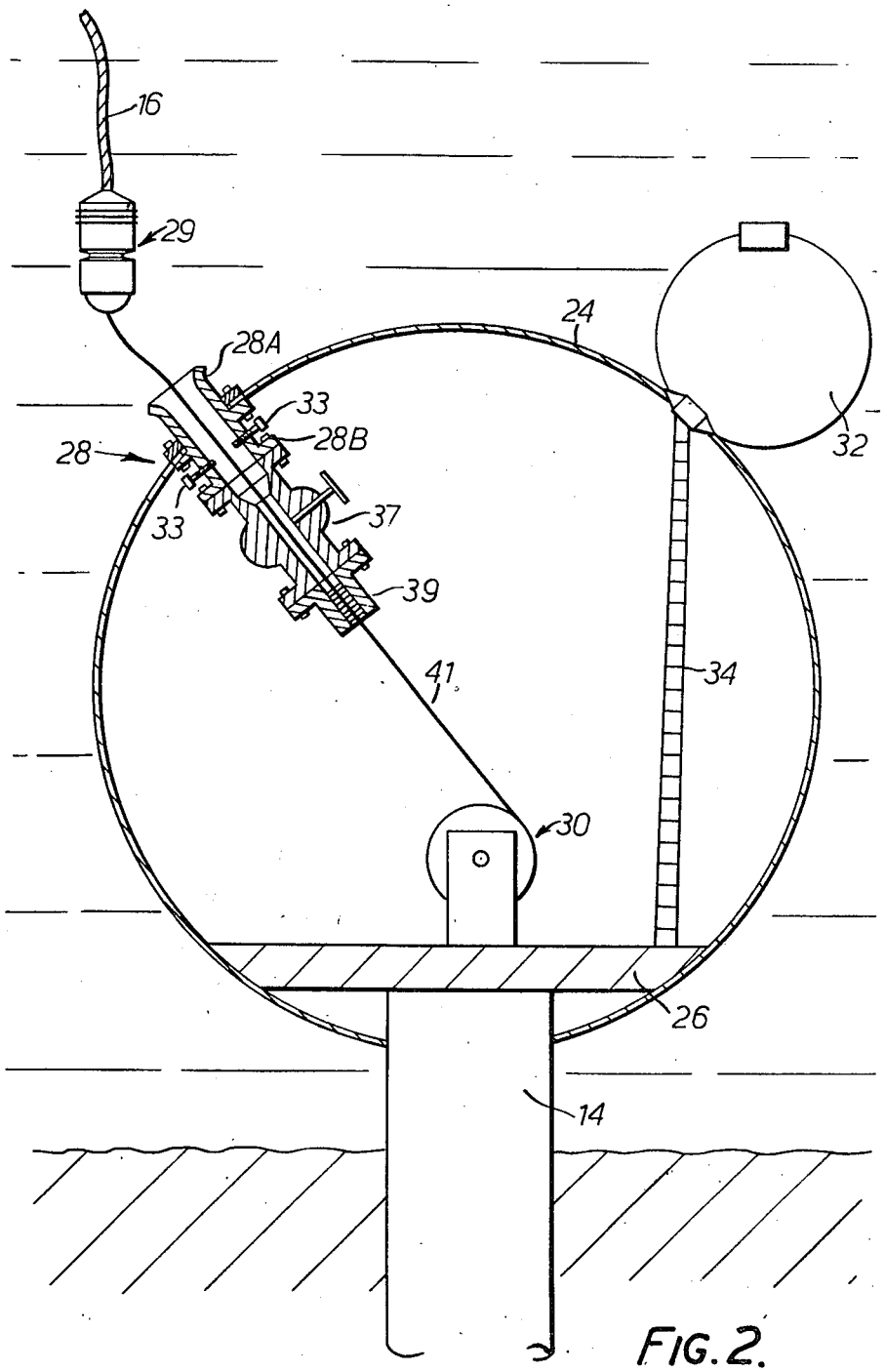
FIG. 2 is a cross-section through a working chamber mounted on a pile driven into the sea bed.

As shown in FIG. 2 each pile 14 carries a working chamber 24 to which each of the cables 16A are secured by a device 28. The air in the working chamber 24 is maintained at a pressure to enable working crews to operate therein. The floor 26 of the working chamber is secured to the pile 14 and carries a winch 30. The wall of the working chamber around the point at which each device 28 is secured is braced by struts (not shown) secured to the pile 14. The device 28 is in two parts 28A and 28B which lie on opposite sides of the chamber wall and are fastened together by means of bolts. Each part 28A and 28B is hollow and when fastened to the chamber wall is aligned with an aperture in the wall, thereby providing access from the outside to the inside of the chamber.

Figure 5:
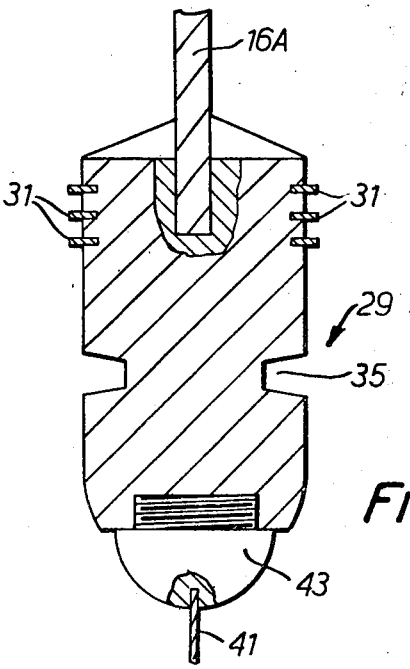
FIG. 5 is a section through a fastening member of a cable to be secured to the chamber of FIG. 2.

The part 28B is arranged to receive a generally cylindrical fastening member 29 to which the cable 16A is babbitted. The inner surface of the portion 28B is highly polished and arranged to be engaged by annular seals 31 (see FIG. 5) in the fastening member. The part 28B also carries two screw threaded fasteners 33 which can be rotated to move radially of the part 28B into engagement with an annular groove 35 in the fastening member 29 when the fastening member 29 is housed in the part 28B. In this way, the fastening member 29 is held captive to the chamber 24 and the seals 31 of the fastening member substantially prevent any water from outside the chamber entering into the chamber.

A valve member 37 is arranged to be secured to the part 28B by means of bolts and a packing member 39 is arranged to be secured to the valve member 37. The valve member 37 and packing member 39 are used in conjunction with a messenger wire 41 when the cable 16A is to be replaced and this will be described in more detail hereinafter.

Mounted on the roof of the working chamber is an airlock 32 which provides access from a submersible vehicle, when docked at the airlock 32, to the working chamber 24. Such airlocks are well known and therefore description thereof will be omitted. A ladder 32 enables the working crews to pass from the airlock 32 to the floor 26 of the working chamber.

It will be appreciated that by this means access to the anchorage points of the cables 16 can be readily gained and that anchorage points can be easily serviced and inspected.

Figure 3:
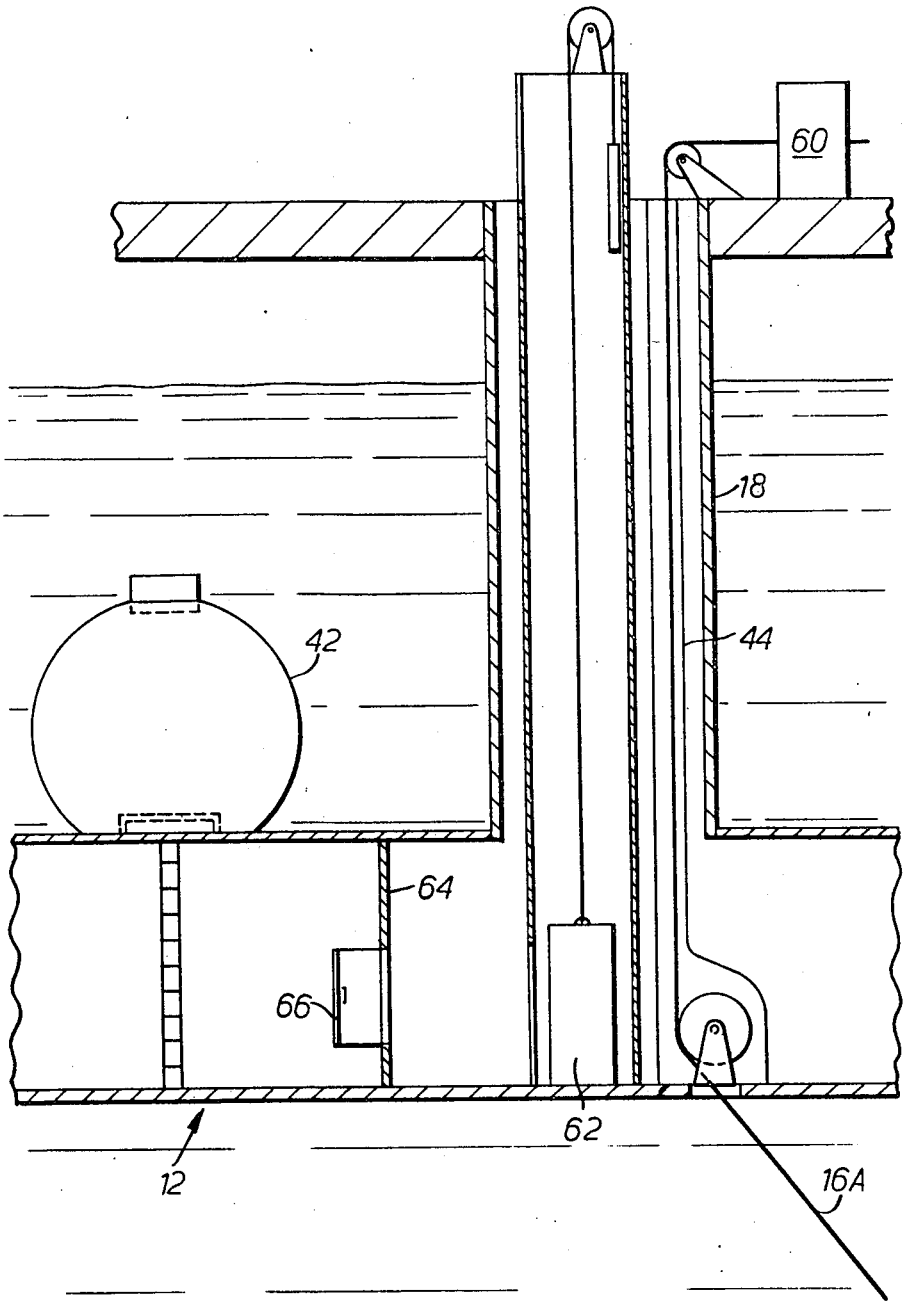
FIG. 3 is a fragmentary cross-section, to an enlarged scale, of part of the buoyancy chamber and deck of the platform.

The cables 16A at their other ends pass into the buoyancy chamber 12 and up a corresponding column 18 onto the deck 20. As shown in FIG. 3 where the cables pass through the chamber 12 and the column 18 they are housed in tubes 44. Oil is poured into each tube so that a layer of oil separates the water in the tube from the air.

Each cable 16 is anchored on the deck 20 through a corresponding hydraulic jack 60. The hydraulic jacks 60 are operable to tension the cables 18 so as to control the level at which the buoyancy chamber is submerged and to haul up the cable when it needs to be replaced. This latter operation will be described in more detail hereinafter.

The buoyancy chamber 12 is hollow and so can house a variety of operating machinery. Access from the deck 20 to the chamber 12 can be gained via an elevator 62 mounted in one of the columns 18. The buoyancy chamber is divided into several compartments by a series of bulkheads 64 (only one shown in FIG. 3). Access from one compartment to another can be gained through doors 66 in the bulkheads and the doors can be closed to seal off a particular compartment when it is desired to flood the compartment with sea water to reduce the buoyancy of the chamber.

An airlock 42 similar to the airlock 32 is mounted on the roof of the buoyancy chamber 12. The submersible 38 is arranged to be normally anchored to the airlock 42 so that working crews can board the submerged submersible 38 from the buoyancy chamber and so avoid all the problems of boarding at sea level when weather conditions deteriorate.

If it is found that one of the cables 16 needs to be replaced the following procedure is followed. The working crew board the submersible from the buoyancy chamber 12 and are carried down to the working chamber in which the cable is anchored. When the crew is inside the working chamber, the messenger wire 41 is secured to the fastening member 29 which is held captive in the part 28B by the fasteners 33. To this end a screw threaded head 43 is babbitted to the free end of the messenger wire 41 and the head 43 screwed into a screw-threaded recess in the fastening member. The other end of the messenger wire 41 is secured to the winch 30 around which the major part of the wire is wound. The valve 37 through which the messenger wire has been previously threaded is then bolted onto the part 28B and the packing member 39 which has also previously been threaded onto the wire is bolted onto the valve member 37.

The fasteners 33 are then operated to release the fastening member 29 (pressure may need to be applied to the fastening member 29 from inside the chamber by means not shown in order to reduce the force needed to withdraw the fastening member 29 from the chamber). Thereupon a signal is given for a working crew on the deck to start hauling up the cable by means of the hydraulic jack 60. In this way the cable is brought up onto the deck with the messenger wire still attached. The other end of the messenger wire is of course still inside the working chamber (the packing member 39 is packed with a series of glands which engage the messenger wire to reduce the amount of sea water entering the chamber through the member 39).

The messenger wire is then released from the old cable and fastened to a fastening member of a new cable. The new cable is then lowered into the sea and the messenger wire is winched back into the working chamber using the winch 30. In this manner the fastening member of the new cable is drawn into the part 28B. The crew can now operate the fasteners 33 to secure the fastening member to the working chamber. Once the cable 16A has been secured, the packing member 39 and valve member 37 are unbolted, and the head 43 of the messenger wire 41 is unscrewed from the fastening member 29.

A cover plate (not shown) can then be bolted to the part 28B in place of the valve member 37 to provide an added seal against the ingress of sea water into the chamber 28.

The jack 60 is then operated to place the new cable under tension. The valve member 37 is only closed in the event that the messenger wire breaks, thereby avoiding flooding of the chamber 24.

Figure 4:
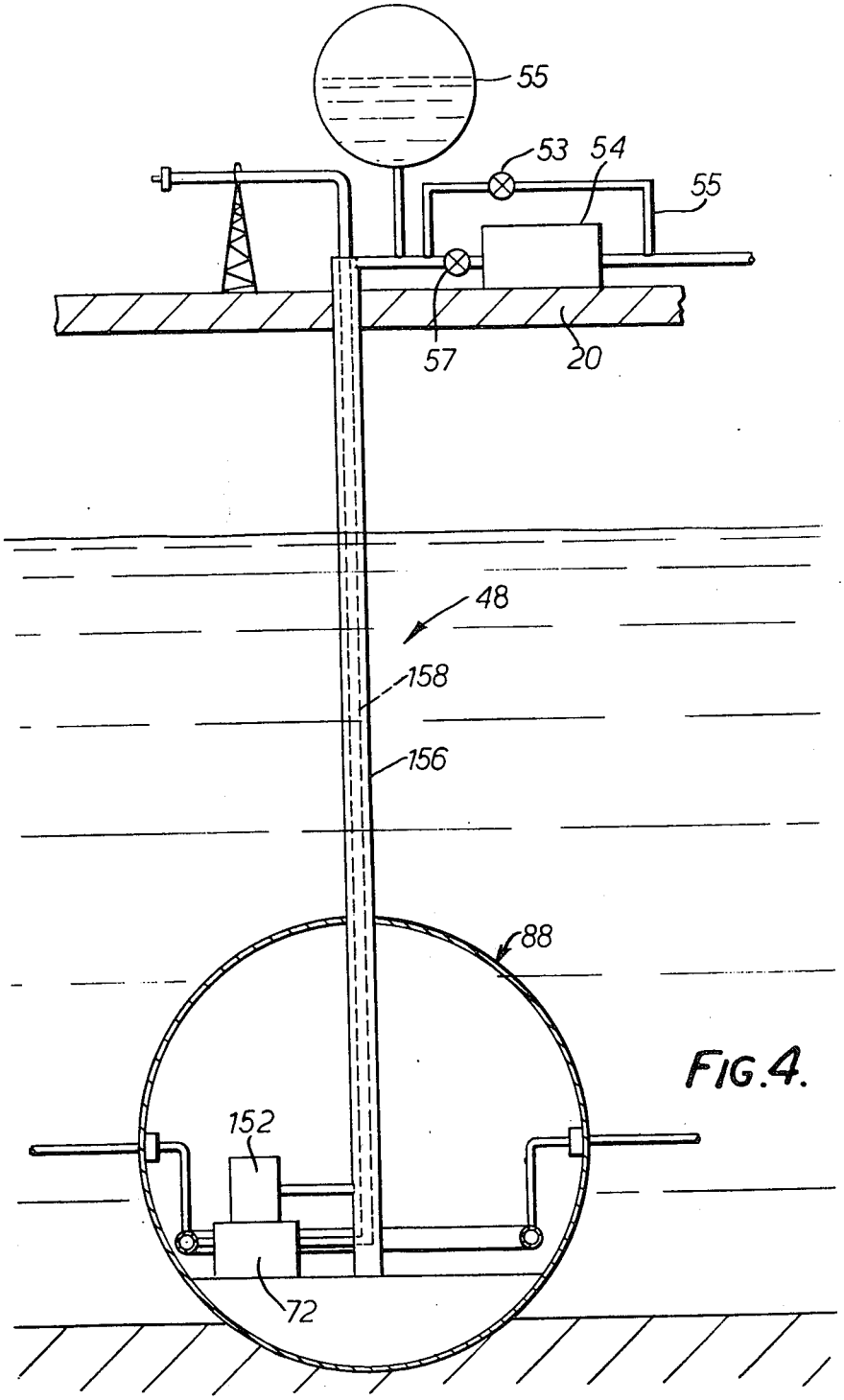
FIG. 4 is a fragmentary cross-section through the deck, a wellhead cluster and a riser coupling the wellhead cluster to the deck.

FIG. 4 shows one of the risers 48 extending from a chamber 88 of the wellhead cluster 46 to the deck 20. As shown, the riser is in the form of two concentric tubes 156 and 158. Fluids from the chamber pass through a valve 72 and are brought up the inner tube 158 onto the deck 20 for processing. The outer tube 156 is supplied with hydraulic fluid under pressure through a one way check valve 57 from a hydraulic pump 154 mounted in the deck 20.

A pressure accumulator 55 mounted on the deck 18 is coupled to the tube 156 downstream of the check valve 57 and is partially filled with the hydraulic fluid. The remainder of the accumulator is filled with nitrogen gas and so the pressure in the tube 156 is maintained substantially unaffected by temperature and other variations. A by-pass loop pipe 55 is coupled between a point just downstream of the check valve 57 and the inlet pump 54. The by-pass loop pipe contains a valve 53 to enable the pressure in the tube 156 to be released.

In the chamber 88, the outer tube feeds the hydraulic fluid to an actuator 152 which controls the valve 72. So long as the pump 154 maintains a predetermined pressure in the tube 156 the actuator 152 maintains the valve 72 in an open condition. If the pump is deactuated to relieve the pressure in the tube 156, the actuator 152 no longer urges the valve 72 into an open state and biassing means within the valve and which normally bias the valve into a closed condition cause the valve to close. In a preferred embodiment the valve is in the form of a ball valve.

It will be appreciated that if for some reason the riser should rupture, this will also relieve the pressure in the tube 156 and the valve 72 will automatically close thereby reducing the leakage of any oil from the riser to a minimum.

In a modification, the actuator can take the form of a device which is responsive only the pressure in the tube 156 lying within a predetermined range to supply fluid under pressure to open a valve 72. In this case, the valve will close if the upper limit of the pressure range is exceeded as well as if the pressure drops below the lower limit of the range.

The hydraulic fluid used is preferably an emulsion of sea water and a bio-degradable corrosion inhibitor.

Although the arrangement of FIG. 4 has been illustrated in the form of a riser for feeding oil up from a well head cluster it will be appreciated that it could be modified to act as a pipe line for conveying fluids from one location to another under water or in other environments.

Many other modifications can be made to the invention without departing from the spirit and scope of the invention as defined by the appended claims.

I claim:

1. A tension leg marine platform comprising a buoyancy chamber, a plurality of anchoring arrangements secured to the sea bed, a plurality of tension legs, each tension leg extending between a corresponding one of the anchoring arrangements and the buoyancy chamber to hold the buoyancy chamber submerged below the level of the sea, a platform, and means supporting the platform on the buoyancy chamber but above the level of the sea, each anchoring arrangement for each leg comprising a pile driven into the sea bed, an air filled working chamber mounted on the pile and defining an orifice through which a said leg can extend into the chamber, and clamping means secured to the chamber and housed within the chamber, the clamping means clamping the leg to the pile.

2. A platform according to claim 1, wherein the chamber includes an airlock to allow access to the chamber from a submersible craft.

3. A tension leg marine platform structure comprising an air filled buoyancy chamber having an airlock, the airlock enabling access between the buoyancy chamber and a submersible craft when docked at the airlock, a deck, a plurality of columns supporting the deck on the chamber to lie above the level of the sea and providing access from the deck to the chamber, a plurality of tension legs each secured at one end to the buoyancy chamber, and a plurality of anchoring arrangements respectively for anchoring the other ends of the tension legs to the sea bed to hold the buoyancy chamber in a submerged state, each anchoring arrangement comprising a pile driven into the sea bed, an air filled working chamber mounted on the pile, and clamping means for clamping a corresponding one of the said tension legs to the pile inside the working chamber, each working chamber having an airlock enabling access between the submersible craft when docked at the airlock and the working chamber.

* * * * *